United States Patent [19]

Vanek

[11] 4,103,587

[45] Aug. 1, 1978

[54] AUTOLOADING PISTOL

[76] Inventor: Chester F. Vanek, 5154 N. Lotus Ave., Chicago, Ill. 60630

[21] Appl. No.: 729,894

[22] Filed: Oct. 6, 1976

[51] Int. Cl.[2] ..... F41D 3/02

[52] U.S. Cl. ..... 89/175; 42/1 Q; 89/145

[58] Field of Search ..... 89/175, 189

[56] References Cited

U.S. PATENT DOCUMENTS

| | | | |
|---|---|---|---|
| 681,439 | 8/1901 | Carr | 89/175 |
| 695,784 | 3/1902 | Bennett et al. | 89/175 |
| 1,801,071 | 4/1931 | Browning | 89/175 |
| 1,897,710 | 2/1933 | Pelo | 89/175 |

*Primary Examiner*—Stephen C. Bentley

[57] ABSTRACT

A pistol in which a recoil-impacted bolt is in engagement with the front link of a toggle; and such link carries a transmittance pin designed to be struck by the hammer of the pistol when the links of the toggle are aligned. The bolt carries a firing pin advanced by the transmittance pin when the pistol is fired. The motion of recoil is transmitted from the bolt to the barrel through the toggle; and such motion later buckles the toggle by means of a supporting link attached to a rear toggle link and to a pistol frame. Also, in the event of recoil, the rear of the barrel structure has a spacer which impinges on the hammer, driving it to a rearward cocked position.

13 Claims, 14 Drawing Figures

4
4
92
30
16a
16c
22a
28
20e
62a
20
20a
18a
26
18
16
16a
56
12c
12b
42
12a
50
12
34
38
40a
40
16g
40b
16h
12k
71
67
36
38b
38
12e
86
40a
91
38c
38c
40b
40c
36b
38b
68
12d
40
42a
16h
16g
40b
12k
38
40c
86
91
42a
68
40c
40a
86
42a
91

16d
24
32
12h
34
12
30
22
66b
40b
12g
40c
86
40a
68
2b
78
83
6
66
16c
28
20
66a
82
64a
64
64b
26
18
64c
90a
16a
5
16
36
12f
68a
36a
42a
91
69
71
70
58a
42
58
12b
76
56
12c
16f
56a
60
88
88a
90
88b
12a
50

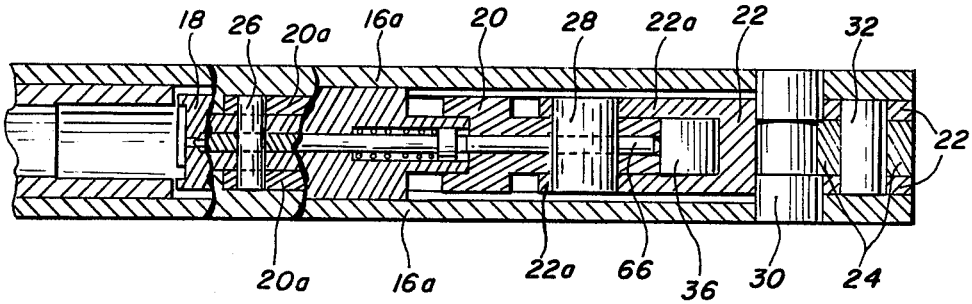
FIG. 4
FIG. 5
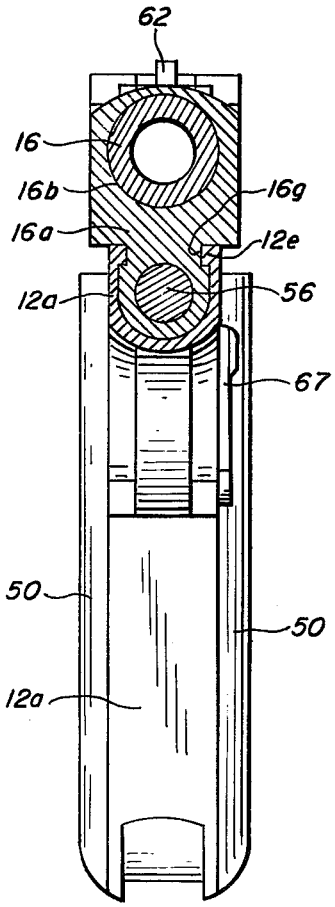
FIG. 6
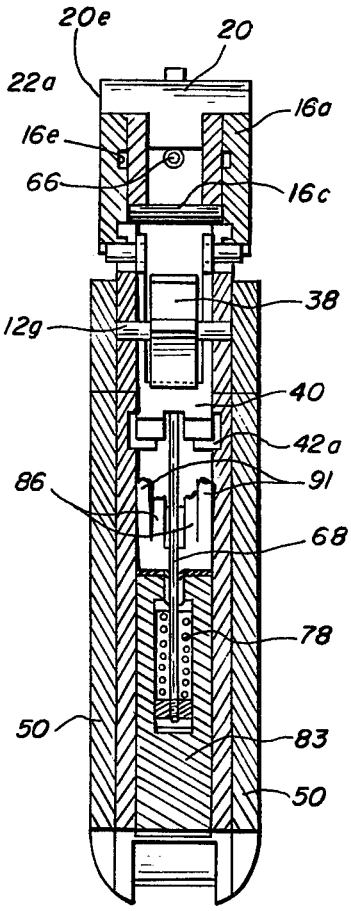

FIG. 7
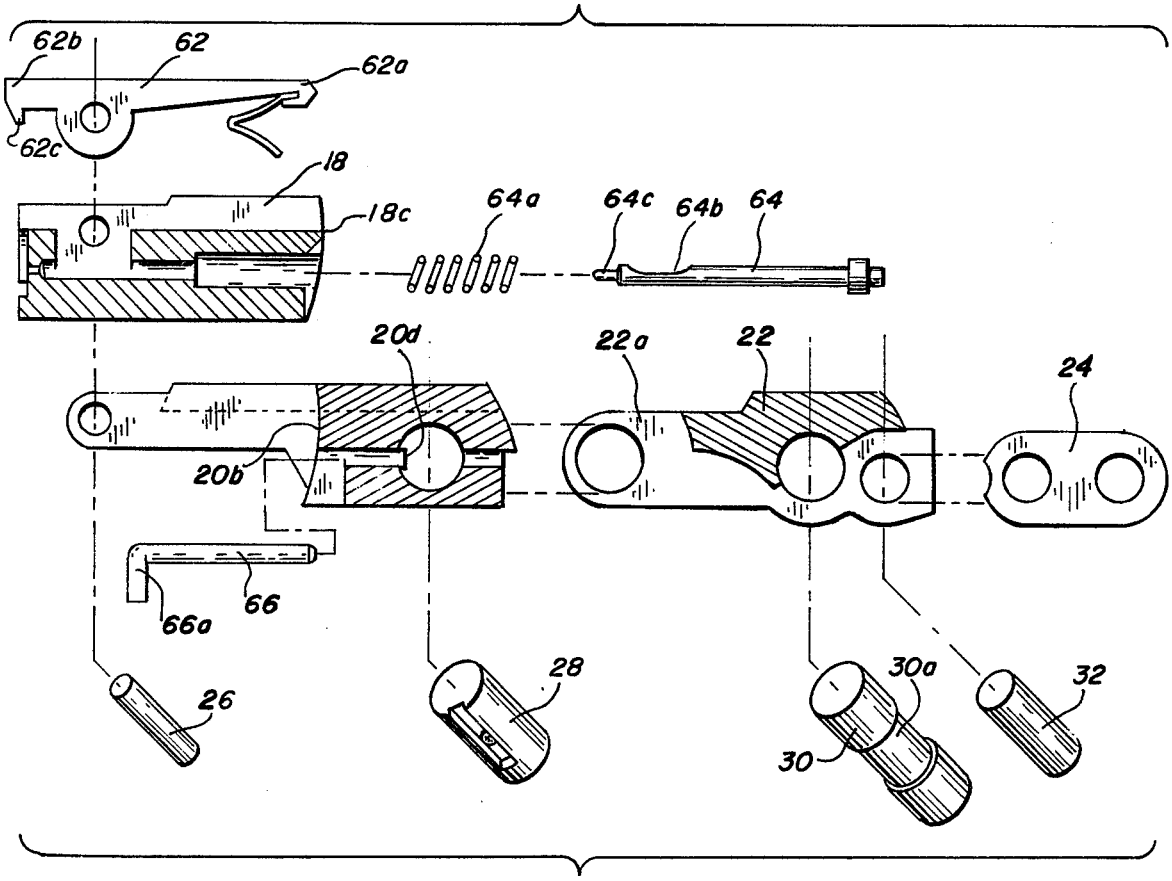
FIG. 8
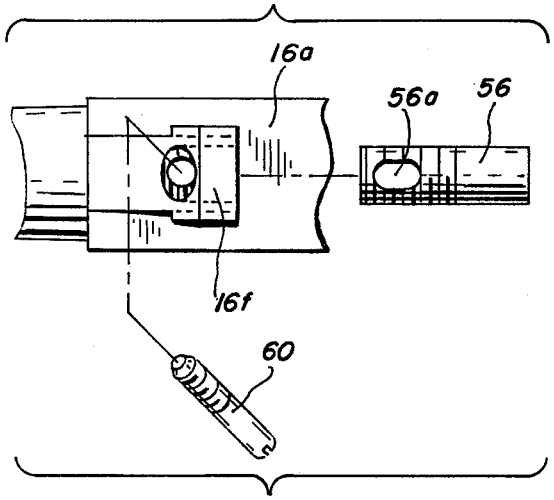
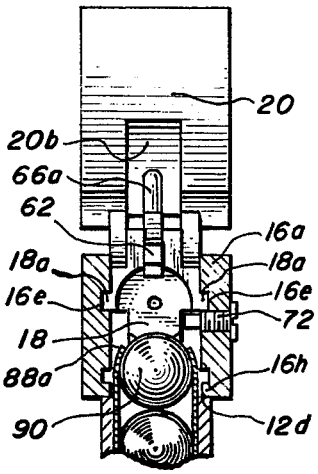
FIG. 9

AUTOLOADING PISTOL

This invention is an improvement in autoloading pistols. Modern developments thereof have attained a fairly satisfactory degree of reliability and accuracy. However, one object of the present development is to present features which attain greater mechanical efficiency and a higher degree of reliability and accuracy. Another object is to provide a pistol constructed to accommodate cartridges of much greater power than those used in conventional autoloading pistols.

A better understanding of the present improvements may be gained by reference to the accompanying drawings, in which FIG. 1 is a side view of the pistol with parts broken away;

FIG. 2 is a longitudinal section of the pistol locked and loaded but uncocked;

FIG. 2*a* is a perspective view of a cartridge magazine;

FIG. 2*b* is a section on the line 2*b*—2*b* of FIG. 2;

FIG. 3 is a view similar to FIG. 2 with the mechanism at the end of the firing recoil, and also showing the magazine in position;

FIG. 3*a* is a view of the mechanism in the process of stripping a cartridge from the magazine and pushing it into the opening of the barrel;

FIG. 3*b* is an enlarged view of the firing system;

FIG. 4 is a section on the line 4—4 of FIG. 1;

FIG. 5 is a section on the line 5—5 of FIG. 2;

Figures 1, 3B, 6A:
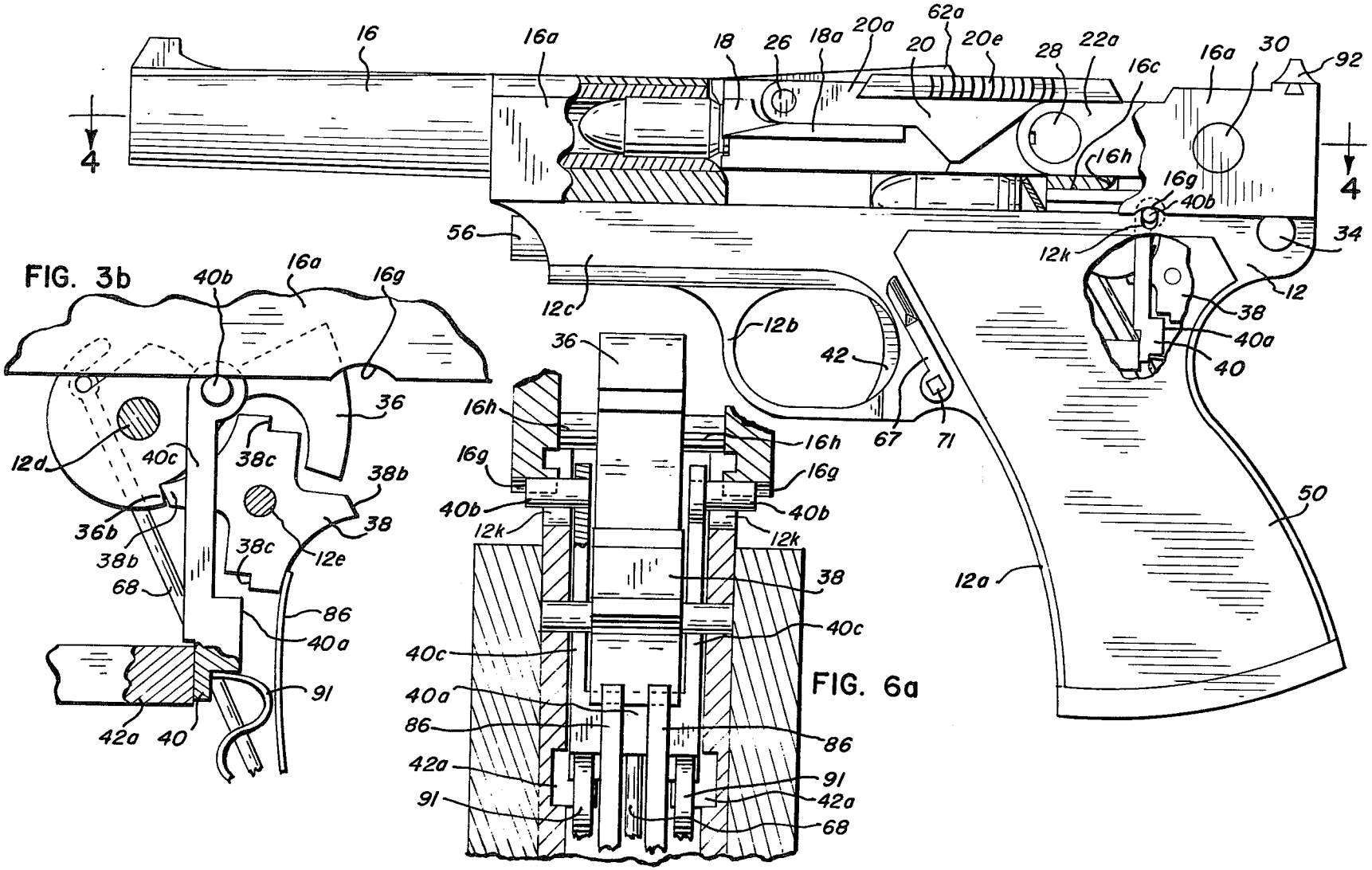
FIG. 6 is a section on the line 6—6 of FIG. 2, with a hammer detail removed to expose a spacer detail, and spring details partially removed to expose sear and disconnector details.

FIG. 6*a* is a magnification of a part of FIG. 6 in which the hammer detail and spring details have been reinserted;

FIG. 7 is an exploded and longitudinally sectioned view of a bolt detail and toggle detail with all small parts;

FIG. 8 is an exploded view of a dead bolt assembly detail; and

Figures 3, 3A:
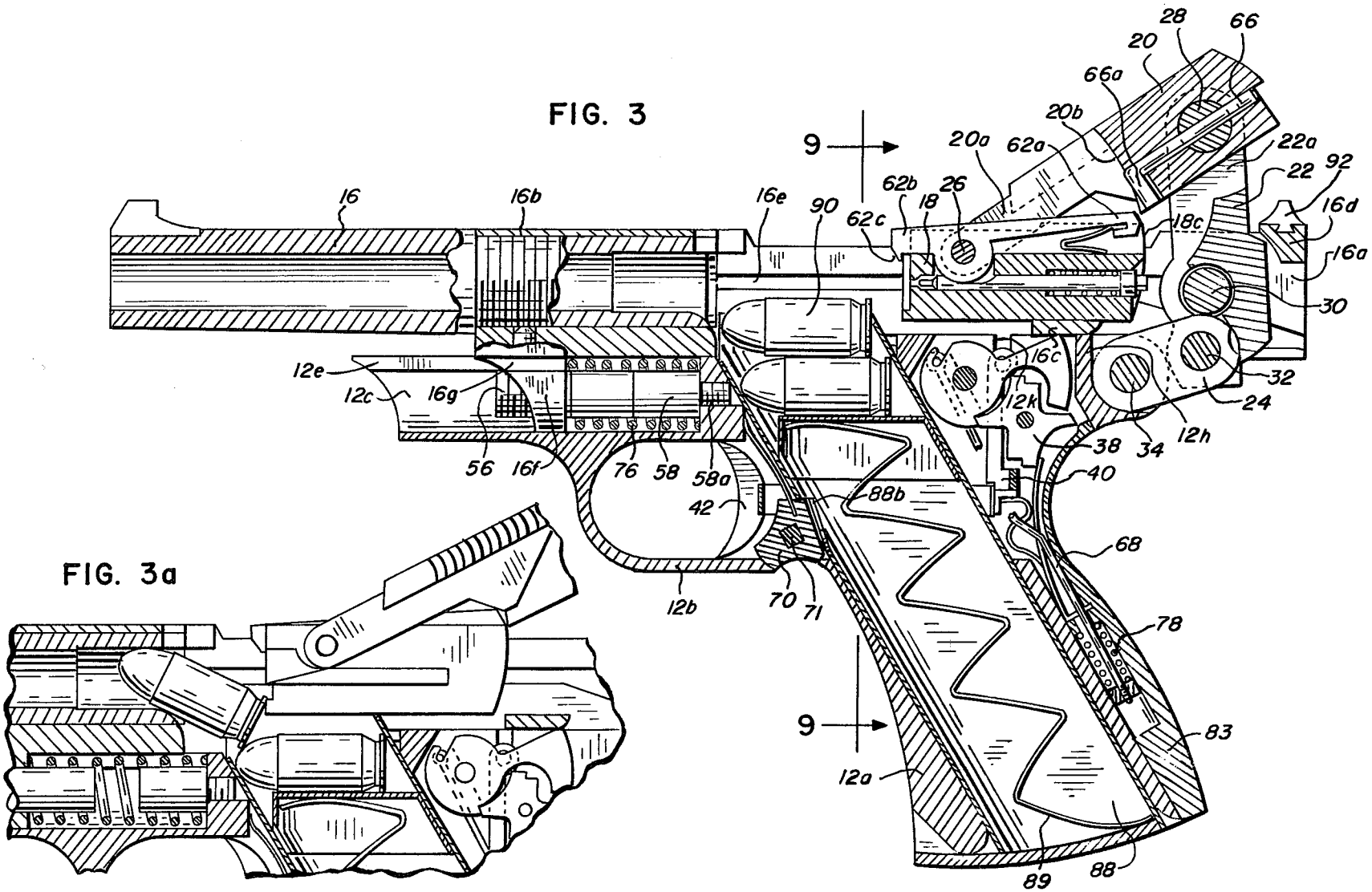

FIG. 9 is a section on the line 9—9 of FIG. 3.

Figures 2, 2A, 2B:
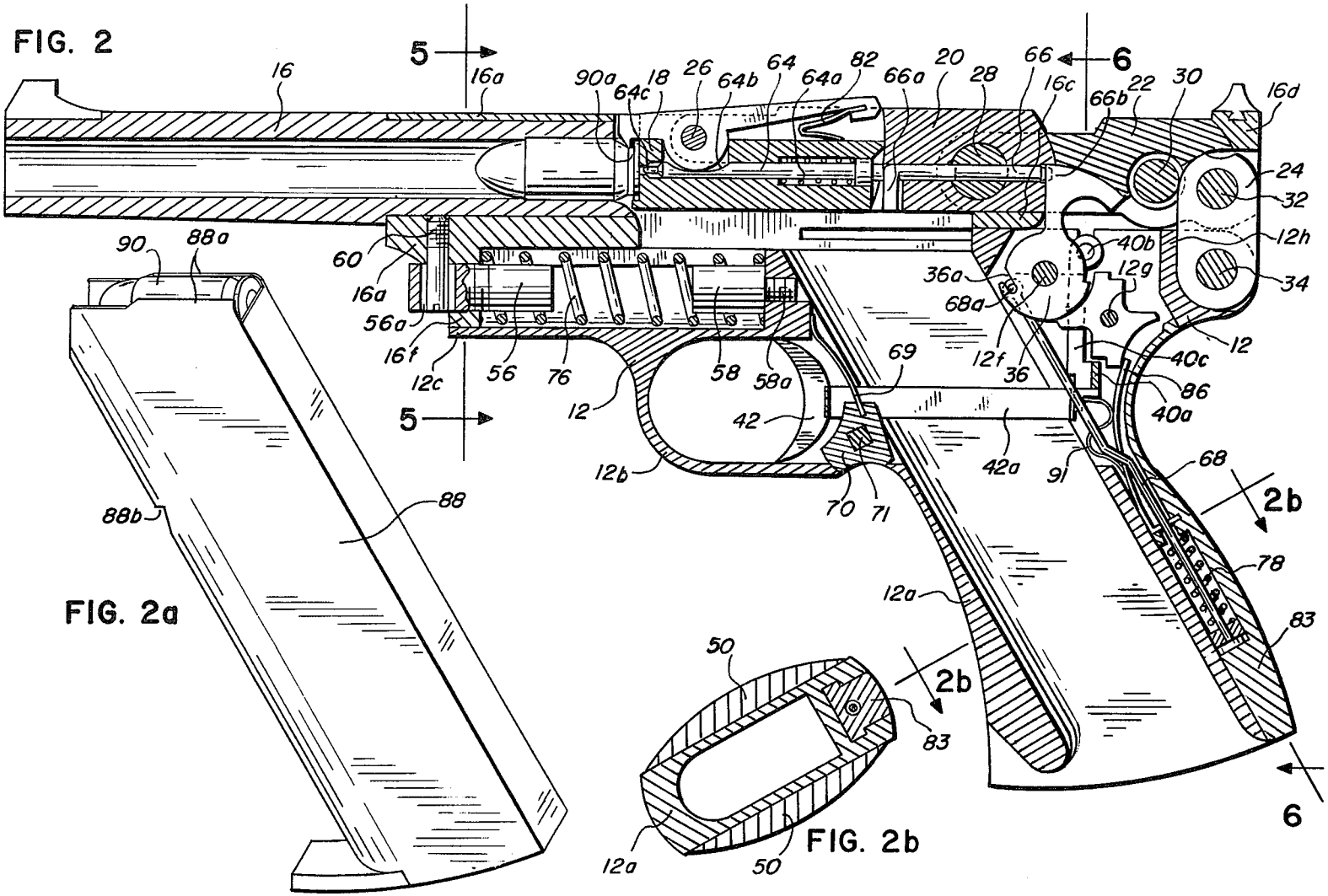

The present description will first present the details of the improved pistol, and then recite the merits of its novel features. To begin, the barrel 16 is made with an extension **16*a* to the rear end of the pistol. The extension is solid in front to thread into the barrel as shown at 16*b* in FIG. 3. It is then made with companion sections which join with a spacer 16*c* above the handle and a terminal spacer 16*d*. This spacer is also used for mounting a rear sight 92. FIG. 5 shows the frame 12 of the pistol extended with a handle 12*a* which receives wooden covers 50 on the sides, as is the usual practice. FIG. 2 shows that the handle has a long internal cavity to accommodate a magazine 88 for a series of cartridges 90**.

The magazine 88 is illustrated in FIG. 2*a*, and also in FIGS. 3 and 3*a*. As is the usual practice, the magazine in made with lips **88*a* at the top to hold down a row of cartridges which are pushed up by a spring 89 contained in the magazine, as shown in FIG. 3. The magazine is provided with a notch 88*b* which engages the magazine lock 70 to hold the magazine in the frame of the pistol as shown in FIG. 3. The magazine lock has a leaf spring 69 which forces it to twist clockwise into the notch of the magazine. A square pin 71 is used as the pivot of the magazine lock. This pin is connected to the lever 67 shown just behind a trigger 42** in FIG. 1. The square pin allows a rotational force imparted to the lever by the hand to be transmitted to the magazine lock. The result is that the lever can be pushed forward to rotate the magazine lock out of the notch in the magazine, thus releasing the magazine from the pistol frame.

When a cartridge 90 is in position for firing as seen in FIG. 2, the most important functional part, a horizontal bolt 18, is behind the cartridge. The bolt is made with lateral ribs **18*a* which are slidable in internal grooves 16*e* made in the extension arms 16*a*, as seen in FIG. 9 and also shown flatly in FIGS. 1 and 3. The cartridge is fired when the bolt is in the forward or closed position of FIG. 2, and receives a rearward thrust from the recoil. This motion is transmitted to the forward link 20 and rear link 22 of a sturdy toggle unit seen in the top right-hand portion of FIG. 2. The toggle is positively locked at the instant of firing, the thrust of the recoil being imparted to the barrel extension 16*a* through the toggle. The recoil of the cartridge in thus resisted by the mass of the barrel and the barrel extension and toggle-bolt assembly at the instant of firing. Later resistance to recoil is given by the mass of the frame through a heavy spring 76 contained in the left hand portion of the frame 12, just above a trigger guard 12*b***.

The connection between the bolt 18 and the toggle unit appears first as a pair of companion arms **20*a* extended forwardly from the toggle link 20 as seen in FIGS. 1, 3, and 4. These arms join with the sides of the bolt to rigidly accomodate a crosspin 26 pivoting the toggle arms 20*a* to the bolt. Also, the rear surfaces 18*c* of the bolt and the front surface 20*b* of the toggle link 20 have matching curvatures radial of the pivot pin 26 as seen in FIG. 3. Thus, when the toggle links straighten to the open position seen in FIG. 2 they become a dead center ram to keep the cartridge fast in the chamber during firing. The rear end of the toggle link 20 is pivoted on a massive cross-pin 28 rigidly connecting a pair of companion arms 22*a* extending forwardly from the rear toggle link 22, such arms appearing more clearly in FIG. 3. The toggle link 22 is journaled to rotate around a second massive cross-pin 30 rigidly connecting the barrel extension arms 16*a*. In the position of the toggle noted in FIG. 2, it is seen that the toggle cross-pin 28 is slightly below a line drawn through the centers of pin 26 and pin 30**, thus providing a passive lock against the recoil force. Thus, from FIGS. 2, 3, 4, and 7 it can be seen that using the massive assembly of the toggle to lock the bolt to the barrel extension provides a solid abutment capable of withstanding the recoil force of more powerful cartridges.

FIGS. 2 and 3 also show that the rearmost part of the toggle link 22 is divided to receive a rigid cross-pin 32 around which is pivoted the upper portion of a supporting link 24; and the lower portion thereof is pivoted on a cross-pin 34 rigidly mounted in the pistol frame 12. It is therefore apparent that a movement of the barrel extension **16*a* to the right from the position of FIG. 2 will bear on the aligned toggle links and cross-pin 32 to swing the supporting link 24 back on its pivot 34. This will draw on the pivot pin 32 and rotate the toggle link 22 clockwise, buckling the toggle and positioning the parts as in FIG. 3. Now the bolt is open and a cartridge can be boosted in front of the face of the bolt. Another advantage of this mechanism is that the toggle is locked positively when open as in FIG. 2, since buckling it requires that the pin 32 be lowered together with the link 24—an action that can only occur when the barrel extension is backed against the force of the spring 76**.

At this point it is important to note that the barrel and its extension do not halt their rearward motion until the bolt is positioned behind the top cartridge of the magazine as in FIG. 3. Thus, unlike conventional locked breech autoloading pistol designs whose mechanisms lose all recoil energy inherent in the rearward motion of the barrel when it is stopped after unlocking from its slide, the present mechanism retains the recoil energy in the barrel for use in backing the bolt and compressing the recoil spring 76. Thus, the operational necessity of a light barrel and heavy slide in the conventional designs does not apply to this invention. The barrel and its extension described herein comprise a massive assembly able to withstand high cartridge pressures, and on which both the front and back sights shown become solidly mounted, lending the present pistol both a greater power capacity and a higher degree of accuracy than found in conventional autoloading pistols.

The powerful spring 76 acts to flatten the toggle while returning the barrel extension to the forward position. The bolt 18 is thereby pushed forward, stripping a cartridge from the magazine as seen in FIG. 3*a* and driving it into the chamber. The sliding guidance of the barrel extension in the frame is maintained by the projection of side ribs **16*h* from the extension into grooves 12*d* in the sides of the rear of the frame 12, as noted in the upper part of FIG. 9, and by the projection of side ribs 12*e* from the frame into grooves 16*g* in the front of the barrel extension as shown in FIG. 5**.

The recoil spring is contained in a bottom frame extension **12*c* forming a recoil spring housing. FIG. 2 shows that a rear dead bolt 58 is screwed at 58*a* into the rear of the recoil spring housing 12*c*. A frontal dead bolt 56 is also provided, and is threaded through a rib 16*f* depending from the front of the barrel extension 16*a*. The dead bolt 56 is adjustable lengthwise by a threading half-turn in one or the other direction; and it is held as adjusted by a screw 60, as shown in FIG. 2. The screw 60 enters upwardly through a bore 56*a* made in the dead bolt to thread into the rib 16*f* and contact the barrel 16, holding it also as adjusted in the barrel extension, and thus allowing a lockable headspace (bolt face to barrel distance) adjustment. The bore 56*a* is elongated in forward and rearward directions as shown in FIG. 8, allowing the necessary clearance to adjust the dead bolt 56**.

A hammer 36 and a sear 38 are mounted in the frame below the toggle link 22; and the hammer and sear are centrally journaled on frame cross-pins **12*f* and 12*g* respectively, to be freely rotatable. When the toggle links are open and aligned, as seen in FIG. 2, the pistol is considered closed and ready to be fired, which occurs when the hammer assumes the struck position shown. It may now be mentioned that the movement of the hammer to that position was procured by the down-pressure of a spring 78 in the handle 12*a* on a pull-rod 68 rising therein to terminate with a hook 68*a* seating in a peripheral pocket 36*a* in the hammer, as shown. FIG. 2*b* is a section through the handle showing the groove and ridge sliding connection between the frame handle 12*a* and a housing 83 for the mainspring 78. The relation between the handle and mainspring housing is the same as it is in the U.S. M1911 automatic pistol. The mainspring housing is maintained in the frame handle by the tension of the mainspring 78 which tends to pull the housing up tightly into the frame, as seen in FIG. 2**.

The sear 38 and a disconnector 40 became involved during the release of the hammer 36 to the struck position. The control for the hammer originates with a trigger 42 carried by a horizontal slide bar **42*a* mounted in the upper part of the handle; and the slide bar is normally urged in forward direction by a spring 91 mounted in the handle, as seen in FIGS. 2, 3, and 3*b*. This spring bears forwardly and upwardly against the rear of the disconnector which in turn bears forwardly against the rear of the slide bar. The disconnector is located between the slide bar and the sear. The trigger is designed to receive only short finger pressure when the pistol is to be fired, in which event the rear end of the slide bar 42*a* is pushed against the disconnector. The sear has opposed detents 38*b*, alternating with opposed steps 38*c*; and a spring 86** from the handle engages the back of the lower step to urge the sear clockwise. Finally, the sear is symmetrical and balanced when free.

It is noted that the disconnector rises at **40*a* to contact the lower sear step 38*c*, and is then divided with arms 40*c* which rise along either side of the hammer, terminating with two co-axial outward pins 40*b* which fit in vertical grooves 12*k* cut in the frame 12. The lower portion of the disconnector is angle shaped to receive the upward and forward push of the spring 91 which, as shown in FIGS. 6 and 6*a*, is made of two separate leaves, each contacting the disconnector beneath one of its arms 40*c*. Under the force of spring 91 the disconnector rises until its pins 40*b* meet the undersurface of the barrel extension 16*a* whose undersurface is cut with a notch 16*g* shown in FIGS. 1 and 3*b*. The latter allows the disconnector pins 40*b* to rise about one sixteenth of an inch in it when the pistol is in the closed position of FIGS. 1 and 2. However, as the mechanism of the pistol begins to open, the notch 16*g* moves rearwardly with the barrel extension, and depresses the disconnector. Finally, the latter is able to pivot about the pins 40*b***.

As the disconnector is normally maintained in raised position by the spring 91 when the pistol is closed, its back surface **40*a* will be in a position to turn the sear counter-clockwise and force the left-hand detent 38*b* out of a peripheral notch 36*b* of the hammer. Now the combined action of the notch 36*b* and the detent checks the hammer from rotating in counter-clockwise direction in response to the pull of the spring-loaded rod 68. Thus, when the trigger is pulled back to fire the cartridge, the disconnector surface 40*a* will impinge on the step 38*c* of the sear to turn the same in counter-clockwise direction. This will withdraw the detent 38*b* from the hammer notch 36*b*, releasing the hammer for a turn to the striking position seen in FIG. 2. As the pistol is fired the recoil backs the barrel extension 16*a***.

It is now noted that the extension spacer **16*c* has a rounded cam 16*h* at its leading end. As the recoil drives the barrel extension rearward, the spacer bears on the hammer to rotate it back to the original or cocked position seen in FIG. 3. This trips the detent 38*b* of the sear until the backing spring 86 forces it to snap back behind the notch 36*b* of the hammer, locking it from rising movement. As shown in FIGS. 6 and 6*a*, the spring 86 is made of two separate leaves on either side of the pull-rod 68, both of which contact the back of the sear step 38*c*. FIG. 3 also shows that the disconnector has been depressed, since as shown in FIG. 3*b*, the notch 16*g* in the barrel extension undersurface which allowed the disconnector to rise, has moved rearward. The disconnector surface 40*a* is thus lowered clear of the sear step 38*c*, and retraction of the trigger will have no effect on the sear as long as the bolt 18 is backed and toggle 20–22** is buckled.

An extractor 62 is shown in the top center of FIG. 2. Its head **62*b* has a hook 62*c*, shown in FIG. 3, which engages inside the back rim 90*a* of the cartridge in the chamber (see FIG. 2) by force of a V-spring 82 between the bolt 18** and the tail portion of the extractor.

The firing of the cartridge is induced by the impact of the hammer against the rear end of a transmittance pin 66, which is horizontally slidable in the toggle link 20; and the pin issues in front of this link with a downbend **66*a*. FIG. 2 shows that this bend engages the rear end of an inertial firing pin 64 extending in line with the transmittance pin 66, as seen in FIG. 2, and slidable forwardly against the resistance of coil spring 64*a* whose purpose is to push back the transmittance pin 66 to the dotted line position shown at 66*b* in FIG. 2 for access by the hammer 36. The firing pin 64 has a tip 64*c* which strikes the primer of the cartridge to fire the same. It is also noted in FIG. 2 that the transmittance pin 66, by passing through cross-pin 28 of the frontal toggle link 20, locks the cross-pin from longitudinal shifting. It is further noted in FIG. 3 that the tail piece 62*a* of the extractor 62, which is hook shaped to clamp one end of the V-spring 82, occurs at a height where it blocks the downbend 66*a* of the transmittance pin 66 when the toggle link is up — as in FIG. 3 — in case that pin has a tendency to slip out as the toggle link is raised. Also, FIG. 7 shows that the cross-pin 28 is prevented from turning and binding the transmittance pin by a spline joint 20*d*. It is further noted in FIG. 2 that the firing pin 64 has a wide arcuate seat 64*b* in the top under the extractor head 62*b* for retention in the bolt 18** with longitudinal clearance.

It is shown in FIG. 7 that the massive cross-pin 30 is cut to a smaller diameter in its central area **30*a*. FIGS. 2, 3, and 4 illustrate that the central cut out portion of pin 30 is occupied by the curved surface of the link 24. This will maintain the pin 30 in position in the barrel extension 16*a* and rear toggle link 22, but allow rotation of the link 24 around pin 30. Also, as shown in FIGS. 2 and 3, the link 24 provides a means for stopping return travel of the barrel extension when the mechanism has arrived at the closed position (FIG. 2) since when the side of link 24 strikes the frame spacer 12*h*** the barrel extension cannot move further forward relative to the frame.

During the course of the recoil operation of the mechanism the cartridge case is withdrawn from the chamber by the extractor attached to the receding bolt by pin 26. As shown in FIG. 3 the space above the bolt in FIG. 2 is open, and an ejector 72 is threaded into the side of the barrel extension as shown in FIG. 9. The ejector is a simple screw with a tip extending inward toward the bolt. As the cartridge case is completely withdrawn from the chamber, its rear end strikes the tip of the ejector and it is flipped upward and out of the gun in a manner similar to that of the Luger pistol.

It is noted in the top of FIG. 1 that the front toggle link 20 is formed with a knurled grip **20*e* by which the hand may grasp the link and pull it from its position in FIG. 2 to the raised position of FIG. 3, as is necessary toward loading the pistol. It can be seen that in the latter stage of retraction of the link, the use of the knurled area 20*e* allows a leverage advantage in the compression of the powerful spring 76**, although a strong rearward pull on the barrel extension itself could effect the same compression and operate the mechanism.

To further clarify the merits of the novel features in the present pistol, first attention is directed to the placement of the barrel extension on top of the frame with no part of the frame surrounding the sides of the barrel extension. In the Luger pistol, and in the only example of a firearm mechanism similar to the one in this pistol, as seen in U.S. Pat. No. 1,518,498, the frame surrounds the sides of the barrel extension. The preferred relation keeps the firearm within the thickness limits for a pistol, makes its construction simple and inexpensive, avoids large contacting surfaces which can cause sticking, and lends the pistol a pleasing and balanced appearance.

Further, it is noted that the pivot pin 26 is used for the connection of both the bolt 18 to the front toggle link 20 and the connection of the extractor 62 to the bolt. This use of the pivot allows the front toggle link to be a relatively long piece compared to the rear toggle link 22. Thus, when the latter has rotated through 90° and is standing up as in FIG. 3, the angle between a line through pins 26 and 28 and a line parallel to the forward direction of motion of the bolt amounts to less than 30°. This minimizes the downward component of force applied to the bolt by the front toggle link when the mechanism is fully open. Therefore, the frictional forces between the bolt 18 and the barrel extension **16*a*** resulting from this downward force are minimized.

Another advantage unique in an articulated breech firearm of the type described herein is the placement of the recoil spring 76 under the barrel, where it is most beneficial for a pistol, whereas to place this spring elsewhere would make the pistol awkward and cumbersome, and would not allow the integration of the spring housing **12*c*** with the dead bolts where they also serve as spring guides. This construction provides an articulated breech mechanism which can absorb large amounts of excess recoil energy.

Another advantage lies in the use of the supporting link 24 to retain the cross-pin 30 in place in the barrel extension.

A further advantage resides in the bottom rib formation **16*f* of the barrel extension, which transmits the forward return pressure of the recoil spring 76** to the barrel extension to operate the mechanism. Here the tongue-in-groove relationship with the frame also imparts strength to the sliding connection between the barrel extension and the frame.

A further advantage resides in the adjustability of the frontal dead bolt 56. It is apparent that the extent of bolt displacement in the barrel extension depends on the magnitude of barrel extension displacement in the frame. The frontal dead bolt adjustment therefore permits changing of the allowed linear displacement of the barrel extension in the frame and therefore the displacement of the bolt 18 in the barrel extension. In this connection, the provision of a locking screw 60 for the adjusted positions of the frontal dead bolt is an important advantage.

A further advantage resides in the described functions of the toggle links, transmittance pin, firing pin and extractor; and it is noted that the supporting link 24 defines the forward limit of the barrel stroke by meeting a massive vertical frame wall, as seen in FIG. 2.

Another advantage is the use of the basic units of a conventional pistol in a novel arrangement productive of compactness and a high degree of mechanical efficiency.

A final advantage is to use a feature commonly known as a cartridge shell ejector in an advantageous position.

I claim:

1. A pistol having a frame with longitudinally directed guides in its sides, a barrel assembly and including a barrel extension mounted on said frame, said which extension is slidable in said guides and having a rear portion of said extension also formed with longitudinally directed guides, a bolt behind the barrel and slidable along the guides of the extension, front and rear toggle links pivotally joined together behind the bolt, the front link pivotally attached to the bolt, the rear link pivotally attached to the rear of said frame, a passive firing pin slidable in bolt and a firing impulse transmittance pin in the front toggle link and aligned with the firing pin when the toggle is open, the transmittance pin having a depending leg which is contacted by the rear of the bolt to hold the pin in the link when the toggle is closed and to project the pin from the rear of the link into the striking path of a hammer when the toggle is open.

2. The structure of claim 1, a pin across the bolt pivoting the front toggle link to it, and an extractor for the shell of the fired cartridge also pivoted on said pin.

3. The structure of claim 1, the firing pin having a surface cavity to receive a base for the extractor to limit rearward movement of the firing pin.

4. The structure of claim 1, the rear toggle link divided with arms alongside the front toggle link, a pivoting cross-pin carried by the arms and passing through the front toggle link, and a longitudinally directed transmittance pin passing through the front toggle link and the pivoting cross-pin to lock the latter against lateral displacement.

5. The structure of claim 4, and means to lock the cross-pin from rotation with respect to the front toggle link and prevent binding of the transmittance pin by the cross-pin.

6. The structure of claim 1, a supporting link pivoted to the rear of the frame and rising to make a pivoting joint with the rear toggle link, and a frame wall in front of the supporting link as an abutment to stop forward motion of the barrel and to resist the buckling of the toggle when the pistol arrives at the closed, ready-to-fire, position.

7. The structure of claim 6, a pin pivoting the rear toggle link to the barrel extension, and means by which the supporting link is used to lock said pin against lateral displacement.

8. The structure of claim 1, said rearward barrel extension divided with companion arms and moving rearwardly on the firing recoil, a hammer pivoted in the frame and having a striker surface, and a spacer between the extension arms to swing the hammer striker rearwardly into cocked position when the barrel extension moves as stated.

9. The structure of claim 7, said locking means comprising a supporting link having a curved surface which occupies a cut-out portion of the pin pivoting the rear toggle link to the barrel extension.

10. A pistol having a frame, a barrel with a rear extension adapted to slide along stationary guides in the frame, a bolt adapted to slide along guides in the barrel extension, a toggle whose front link is rotatably mounted on the bolt and whose rear link is rotatably mounted on the barrel extension, a supporting link pivotally attached to the rear toggle link and to the frame, a wall in the frame in front of the supporting link to form an abutment for the link to stop forward motion of the barrel and to resist the buckling of the toggle when the bolt arrives at the closed, ready-to-fire position, a firing hammer rotatably mounted in the frame, and a firing pin adapted to be struck by the hammer, said front link carrying a firing impulse transmittance pin having a depending leg which is contacted by the rear of the bolt to hold the pin in the link when the toggle is closed and to project the pin from the rear of the link into the striking path of said hammer.

11. A pistol having a frame, a frontal barrel adapted to be loaded with a cartridge, a recoil-impacted bolt behind the barrel, front and rear toggle links behind the bolt, a passive firing pin in the bolt, a firing impulse transmittance pin in the front toggle link and aligned with the firing pin when the toggle is open, a hammer positioned to strike toward the rear of the front toggle link, means urging the firing pin rearwardly in the bolt to project the transmittance pin behind the front toggle link in the striking path of said hammer, said transmittance pin having a frontal enlargement contacted by the firing pin into contact with the front toggle link to limit the projection of said transmittance pin from the rear of said front toggle link to be struck by said hammer.

12. A pistol having a frame, a frontal barrel adapted to be loaded with a cartridge, a recoil-impacted bolt behind the barrel, front and rear toggle links behind the bolt, a passive firing pin in the bolt, a firing impulse transmittance pin in the front toggle link and aligned with the firing pin when the toggle is open, a supporting link pivoted to the rear of the frame and rising to make a pivoting joint with the rear toggle link, a frame wall in front of the supporting link as an abutment to stop forward motion of the barrel and to resist the buckling of the toggle when the pistol arrives at the closed, ready-to-fire position, a pin pivoting the rear toggle link to the barrel extension, and means by which the supporting link is used to lock said pin against lateral displacement, said locking means comprising a supporting link having a curved surface which occupies a cut-out portion of a pin pivoting the rear toggle link to the barrel extension.

13. A firearm comprising:

a receiver group having a counter-recoil assembly, trigger assembly operatably connected to a hammer assembly and a recess to receive cartridges;

a barrel group slidably mounted on said receiver group and having a barrel and a barrel extension carrying adjustable means which cooperates with said counter-recoil assembly to adjust the headspace of said firearm; and a recoil-activated articulated breech group slidably mounted in said barrel extension and having a bolt assembly, an articulated two-link toggle assembly having a first pivotal connection at one end with said bolt assembly and a second pivotal connection near the opposite end of said toggle assembly with the rear of said barrel extension and a link assembly which is pivotally connected at one end to said receiver group and pivotally connected at its opposite end to the rear of said toggle assembly to pivot said toggle assembly about said second pivotal connection during recoil and counter-recoil, said link assembly making contact at the termination of counter-recoil with a wall forming an abutment in the rear of said receiver group to stop the forward motion of the breech group and to resist the buckling of the toggle when the breech group arrives at the closed, ready-to-fire position, the part of the toggle assembly pivotally connected to said bolt assembly carrying at its rearward end a firing impulse transmittance pin slidably mounted therein, the transmittance pin having a depending leg which is contacted by the rear of the bolt assembly to hold the pin in the toggle part when the toggle assembly is closed and to project the pin from the rear of the toggle part into the striking path of a hammer when the toggle assembly is open, the part of the toggle assembly pivotally connected to said barrel extension being pivotally mounted on a fixed pin in the rear portion of said other part of said toggle assembly through which pin said transmittance pin moves, said fixed pin being so positioned in said toggle assembly so as to be positioned when the toggle assembly is opened so that the center line of said fixed pin is between a line connecting the first center lines of the first and second pivotal connections of said toggle assembly to lock said articulated breech group against movement at the time of firing of the cartridge.

* * * * *